US007255471B2

(12) United States Patent
Diorio et al.

(10) Patent No.: US 7,255,471 B2
(45) Date of Patent: Aug. 14, 2007

(54) SAFETY NIGHT LIGHT

(75) Inventors: Joseph Diorio, North Providence, RI (US); Jenkin P. Hua, Plainsboro, NJ (US); Eddie A. Ling, Great Neck, NY (US); Anthony Vallone, North Massapequa, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 101 days.

(21) Appl. No.: 11/080,430

(22) Filed: Mar. 16, 2005

(65) Prior Publication Data

US 2005/0276077 A1 Dec. 15, 2005

Related U.S. Application Data

(60) Provisional application No. 60/557,653, filed on Mar. 30, 2004.

(51) Int. Cl.

| | |
|---|---|
| ***H01R 33/96*** | (2006.01) |
| ***H01R 13/44*** | (2006.01) |
| ***F21V 23/04*** | (2006.01) |
| ***F21V 1/00*** | (2006.01) |

(52) U.S. Cl. ..... 362/641; 362/353; 362/394; 362/437; 439/135

(58) Field of Classification Search ..... 362/640–642, 362/644, 650, 653, 654, 659, 353, 394, 437, 362/439; 439/135, 136, 142, 144, 360, 365, 439/373

See application file for complete search history.

(56) References Cited

U.S. PATENT DOCUMENTS

| | | | | |
|---|---|---|---|---|
| 2,841,695 | A * | 7/1958 | Bentsen | 362/650 |
| 4,343,032 | A * | 8/1982 | Schwartz | 362/659 |
| 4,611,266 | A * | 9/1986 | Schwartz | 362/641 |
| 4,714,984 | A * | 12/1987 | Spector | 362/641 |
| 5,495,402 | A * | 2/1996 | Houssian | 362/642 |
| 6,022,128 | A * | 2/2000 | Chi | 362/641 |
| 7,097,331 | B2 * | 8/2006 | Chen | 362/394 |

* cited by examiner

*Primary Examiner*—Alan Cariaso
(74) *Attorney, Agent, or Firm*—Paul J. Sutton

(57) ABSTRACT

A night light having a lamp socket for holding a lamp and a lamp shade around the lamp such that when the lamp shade is removed from the lamp socket, power to the lamp is automatically interrupted.

8 Claims, 2 Drawing Sheets

SAFETY NIGHT LIGHT

This application claims the benefit of the filing date of a provisional application having Ser. No. 60/557,653 which was filed on Mar. 30, 2004.

BACKGROUND OF THE INVENTION

1. Field of the Invention

This invention relates generally to a night light and, more particularly, to a lamp holder having a safety switch which automatically interrupts the flow of electricity to the lamp when a detachable lamp shade is removed from the lamp holder.

2. Description of the Related Art

Night lights for residential use are well known in the art. They are used primarily to dimly illuminate corridors and rooms. Night lights include a lamp socket for holding a lamp and a switch which serves to control the flow of electricity or power to the lamp. Night lights may include a lampshade for partially blocking light from a lamp to prevent glare. However, a night light may pose a danger to a person when the lamp is removed from the lamp socket because electricity may still be flowing to the lamp socket. What is needed is a night light that reduces such a danger.

SUMMARY OF THE DISCLOSURE

The present invention helps overcome some of the deficiencies of the prior art by providing a night light that automatically interrupts power to a lamp socket when the lamp shade around the lamp of a night light is removed from the base of the night light. This prevents a person from accessing a live part of the lamp socket and receiving an electrical shock. The live part of the lamp socket refers to a center electrical contact located at the base of the socket and/or the threaded contacts around the circumference of the internal socket opening.

In one embodiment of the invention, a night light is provided that includes a lamp holder having a socket for receiving a lamp, a lamp shade detachably coupled to the socket, and an actuator that interrupts an electrical conductive path to the socket when the lamp shade is detached.

The above stated and other embodiments and advantages of the invention will become more apparent from the following detailed description when taken with the accompanying drawings. It will be understood, however, that the drawings are for the purposes of illustration and are not to be construed as defining the scope or limits of the invention, references being had for the latter purpose to the claims appended hereto.

BRIEF DESCRIPTION OF THE DRAWINGS

Preferred embodiments of the present application are described herein with reference to the drawings in which similar elements are given similar reference characters, wherein.

DETAILED DESCRIPTION OF THE INVENTION

The present invention provides a night light having a lamp holder for holding a lamp and a detachable lamp shade around the lamp holder such that when the lamp shade is detached from the lamp holder, power to a lamp socket is automatically interrupted to preventing a person from accessing a live part of the lamp socket and receiving an electrical shock. The live part of the lamp socket refers to a center electrical contact located at the base of the socket and/or the threaded contact around the circumference of the internal socket opening.

Figure 1:
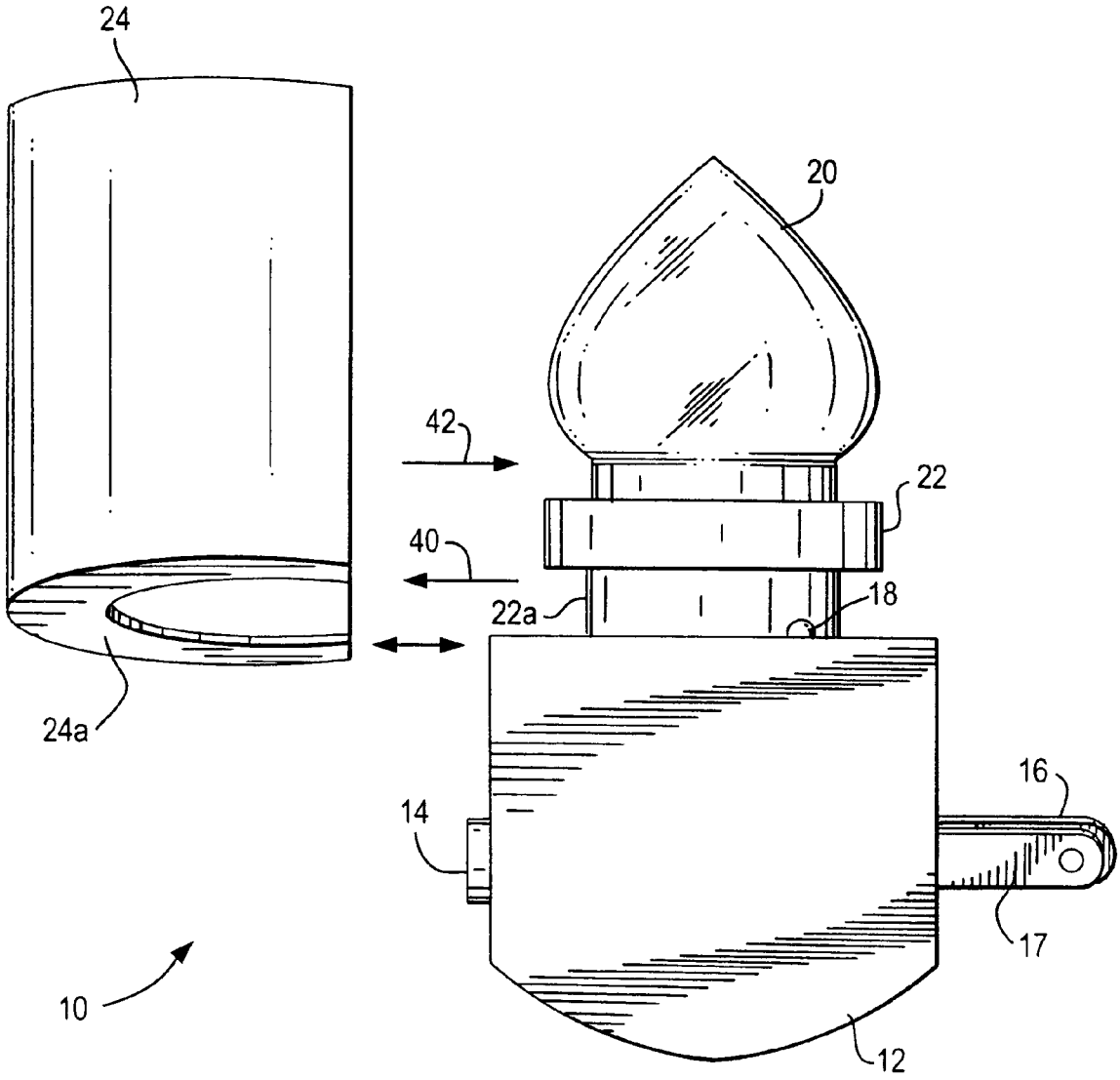
FIG. 1 is a partially exploded side view of a night light lamp holder having a lamp and lamp shade.

Referring to FIG. 1, there is shown a night light 10 comprising a lamp holder or housing 12 with a lamp 20 for providing a low level of illumination in an otherwise dark area such as a hallway. A pair of prongs 16, 17 is provided for insertion into a standard wall socket (not shown) for providing a source of power such as standard household power (120 VAC). An ON/OFF switch (e.g., toggle switch) 14 protrudes through an opening located at a front portion of the housing 12 to allow a user to manually control the flow of power to the lamp 20. A detachable shade 24 supports a flange 24*a* which is received by and snaps around a receiving channel 22*a* of a lamp socket 22 located at the neck or top of the lamp holder 12.

The lamp shade 24 can be opaque, translucent, or a combination to prevent glare from direct exposure to the illuminating lamp 20. The shade 24 can be attached (arrow 42) or coupled to the channel 22*a* to engage and depress an actuator member 18 which controls the flow of electricity to the lamp socket 22 and the lamp 20. The actuator member 18 is part of a power interrupting structure located within the housing for controlling (making and breaking) the flow of current to the lamp 20. When the shade 24 is removed (arrow 40) or detached from the channel 22*a*, the shade 24 disengages the actuator member 18 thereby causing the internal power interrupting structure to interrupt the flow of electricity to the lamp socket 22 and to the lamp 20. Thus, the present invention allows a person to remove or replace a lamp from the night light without exposing the person to the live parts of the lamp socket 22.

Figure 2:
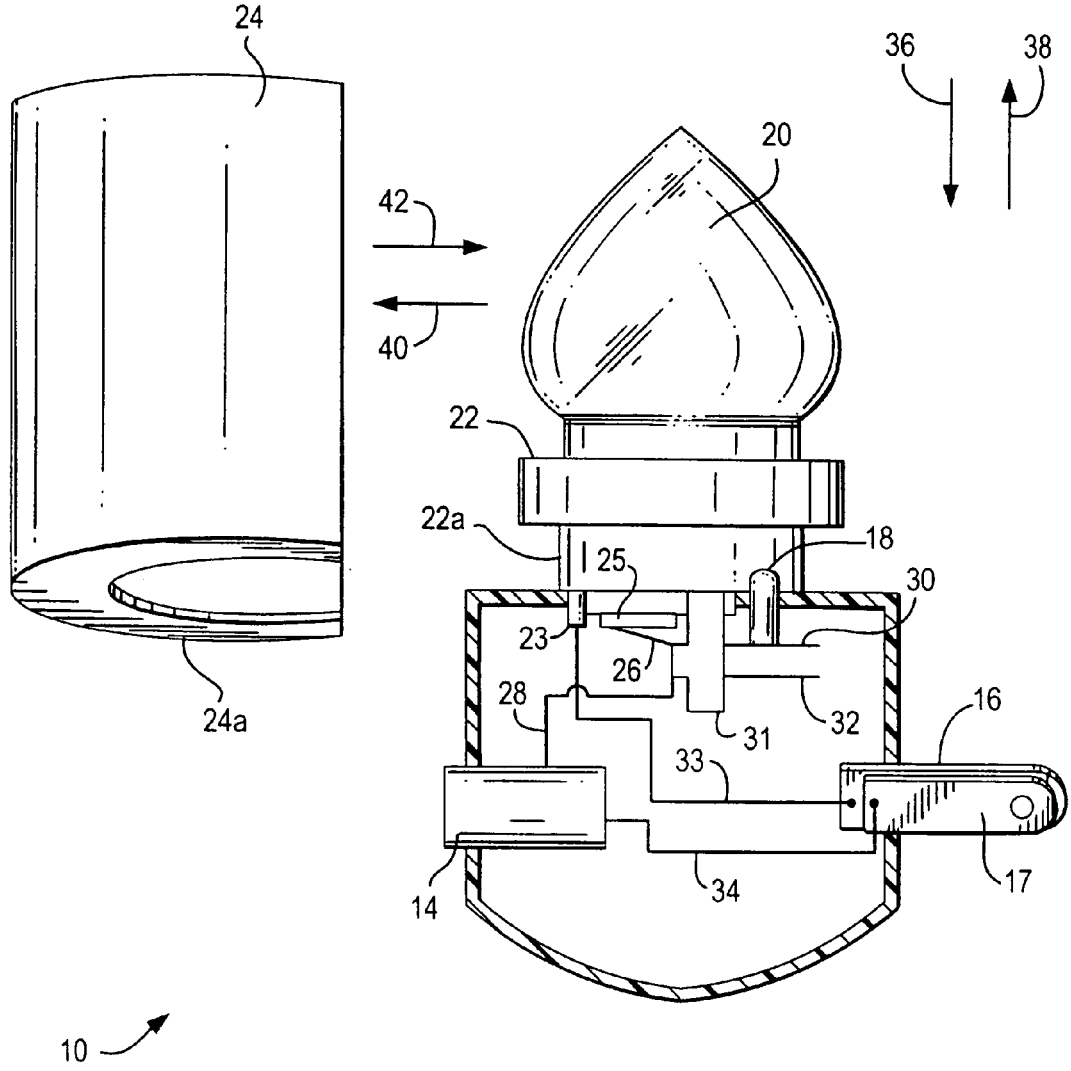
FIG. 2 is a partial cut away view of the night light of FIG. 1 showing a power interrupting structure.

Referring to FIG. 2, the lamp housing 12 provides support for the component parts of the night light 10 including the actuator member 18 and the power interrupting structure for interrupting the flow of power to the lamp socket 22 and the lamp 20. While the actuator 18 is shown as a button, it is understood that the actuator can any other actuator such as a lever that remains depressed by the shade 24 regardless of its orientation, or the actuator can be designed and located to allow the contacts to open when the shade is still located in the channel but rotated to an OFF position. The power interrupting structure includes an interruptible conductive path comprising a flat conductive strip of material such as phosphor bronze or the like which is mounted, at its center, to an insulating support member 31 such that the ends of the flat conductive strip provides a first yieldable contact 26 and a second yieldable contact 30. The flexible end of contact 26 applies a spring-like upward force (in the direction of arrow 38) to make electrical contact with a center contact 25 located in the base of the lamp 20 to provide power to the lamp 20. The flexible end of the contact 26 is positioned to be urged downward (in the direction of arrow 36) by actuator member 18 to cause the end of contact 30 to make electrical contact with contact 32 to complete an electrical path. The normally open contacts 30, 32 are located within the lamp holder 12.

A first conductor (e.g., wire) 28 is electrically connected between contact 32 and a terminal of the ON/OFF switch 14. A second conductor 34 is electrically connected between the other terminal of the switch 14 and the prong 17. In other words, the ON/OFF switch is electrically connected in series with prong 17 and contact 32. A third conductor 33 is electrically connected between the prong 16 and a second contact 23 of the lamp to complete an electrical path. Prongs 16, 17 receive AC power from a source of AC such as a standard household wall socket when the prongs 16, 17 are inserted into the wall socket.

In operation, when the prongs 16, 17 are inserted into a wall socket or receptacle (not shown) to receive power, and when the lamp shade 24 is detached (arrow 40) from the lamp socket 22, the actuator 18 is free to move up (arrow 38), the normally open contacts 30, 32 spring open, and power to the lamp 20 is automatically interrupted. Thus, power to the lamp is automatically interrupted to prevent a person from accessing a live part of the lamp holder regardless of the state of the ON/OFF switch 14.

On the other hand, when the lamp shade 24 is attached to the lamp socket 22, an electrical path is completed to allow current to flow to the lamp 20. In particular, as the lamp shade 24 is moved in the direction shown by arrow 42, the flange 24*a* snaps around a receiving channel 22*a* of the lamp socket 22 located at the neck or top of the lamp holder 12. A portion of the flange 24*a* applies a downward force (arrow 36) to the actuator 18 to keep the normally open contacts 30, 32 closed to provide a complete electrical path. The electrical path comprises a first path and second path: current flows from an external AC source via a first path defined by prong 17, conductor 34, switch 14, conductor 28, contacts 32, 30 (normally open contacts), contact 26, contact 25 of the lamp 20 and the current returns via the second path defined by contact 23 of the lamp 20, conductor 33, to prong 16 and back to the AC source. Since the ON/OFF switch 14 is in series with the electrical path, the lamp 20 is illuminated (ON) when the switch is in the ON position, and the lamp is dark (OFF) when the switch is in the OFF position.

Although one embodiment of the power interrupting structure has been described above, it should be understood to one skilled in the art that the structure can be implemented as a microswitch or other structure that can make/break an electrical path in response to an actuator action. In addition, although the ON/OFF switch 14 is shown as a toggle switch that provides a manual means of completing an electrical path, an automatic means of completing the electrical path can be used such as an ON/OFF switch employing a photocell that is responsive to ambient light. For example, the photocell completes an electrical path (ON) when it senses a dark condition (e.g., nighttime) and interrupts the electrical path (OFF) when it sense a light condition (e.g., daytime).

While there have been shown and described and pointed out the fundamental features of the invention as applied to the preferred embodiment as is presently contemplated for carrying thereout, it will be understood that various omissions and substitutions and changes of the form and details of the device described and illustrated and in its operation may be made by those skilled in the art, without departing from the spirit of the invention.

What is claimed is:

1. A night light comprising:

a lamp holder having a lamp socket for receiving a lamp;

a pair of prongs for receiving power from a wall socket;

normally open contacts interposed between one of said prongs and said lamp socket;

an actuator coupled to urge said normally open contacts to close;

a lamp shade detachably coupled to said lamp socket to engage said actuator and urge said normally open contacts to close when coupled to said socket; and an on/off switch coupled in series with said normally open contacts to manually control the flow of current to said contacts.

2. The night light of claim 1, wherein said prongs extend from said lamp holder for insertion into said wall socket.

3. The night light of claim 1, wherein said on/off switch extends partially through said lamp holder to allow a user to depress said on/off switch.

4. The night light of claim 1, wherein said lamp socket includes an opening to threadably accept a threaded lamp.

5. The night light of claim 1, wherein said lamp socket includes a channel around the base of said lamp socket for receiving said lamp shade.

6. The night light of claim 1, wherein said lamp socket includes a contact for supplying power to a contact of said lamp.

7. The night light of claim 5, wherein said actuator extends partially into said channel for engaging said lamp shade.

8. The night light of claim 1, wherein said on/off switch includes a photocell to automatically control the flow of current to said contacts.

* * * * *